US006605890B1

(12) United States Patent
Tanabe et al.

(10) Patent No.: US 6,605,890 B1
(45) Date of Patent: Aug. 12, 2003

(54) COLOR CATHODE RAY TUBE HAVING AN IMPROVED SHADOW MASK

(75) Inventors: Hideo Tanabe, Tokyo (JP); Mitsuru Watanabe, Tokyo (JP); Takao Nakamura, Tokyo (JP); Hiroshi Kawasaki, Chiba-Ken (JP)

(73) Assignee: Hitachi, Ltd., Tokyo (JP)

( * ) Notice: Subject to any disclaimer, the term of this patent is extended or adjusted under 35 U.S.C. 154(b) by 101 days.

(21) Appl. No.: 09/598,323

(22) Filed: Jun. 21, 2000

(30) Foreign Application Priority Data

Jun. 23, 1999 (JP) ..... 11-176834

(51) Int. Cl.[7] ..... H01J 29/07
(52) U.S. Cl. ..... 313/403; 313/404; 313/407
(58) Field of Search ..... 313/402, 403, 313/404, 407, 408

(56) References Cited

U.S. PATENT DOCUMENTS 5,363,011 A * 11/1994 Fendley ..... 313/408
5,391,957 A * 2/1995 Fendley ..... 313/402
5,394,051 A * 2/1995 Lerner ..... 313/403

FOREIGN PATENT DOCUMENTS

| | | | |
|---|---|---|---|
| JP | 4359841 | * 12/1992 | ..... 313/402 |
| JP | 5-198271 | 8/1993 | |
| JP | 6-275204 | 9/1994 | |
| JP | 8-227667 | 9/1996 | |
| JP | 10-199438 | 7/1998 | |
| JP | 10-326575 | 12/1998 | |
| JP | 11-73889 | 3/1999 | |

* cited by examiner

*Primary Examiner*—Ashok Patel

(57) ABSTRACT

A color cathode ray tube has an electron gun, a phosphor screen, and a shadow mask closely spaced from the phosphor screen. The shadow mask has plural strips extending in a direction perpendicular to a horizontal scanning direction of electron beams emitted from the electron gun and plural bridge portions connecting adjacent ones among the plural strips. The shadow mask is formed with an aperture area having plural slot-shaped electron beam apertures therein. The shadow mask is provided with at least one wire held under tension in the extending direction of the plural strips so as to be superposed on a surface of one of the plural strips in the aperture area. The surface of the one of the plural strips is a surface of the one of the plural strips facing the electron gun.

12 Claims, 11 Drawing Sheets

COLOR CATHODE RAY TUBE HAVING AN IMPROVED SHADOW MASK

BACKGROUND OF THE INVENTION

The present invention relates to a color cathode ray tube, and in particular to a color cathode ray tube having a so-called slot type shadow mask.

A color cathode ray tube used for a TV receiver, or a monitor for a personal computer or other information equipment is formed of a vacuum envelope comprising a face panel having a mosaic phosphor screen coated with plural-color phosphors (usually red, green and blue), a neck housing an electron gun and a funnel for connecting the neck to the face panel.

A deflection yoke is mounted around the outside of the transition region between the funnel and the neck, and intensity-modulated electron beams emitted from the electron gun are scanned horizontally and vertically on the phosphor screen by horizontal and vertical deflection magnetic fields generated by the deflection yoke to reproduce an image.

A shadow mask is closely spaced from the phosphor screen, and serves as a so-called color selection electrode for making each of a plurality of electron beams (usually three beams for red, green and blue, respectively) emitted from the electron gun impinge on only phosphor elements of a corresponding color.

Various types of shadow masks are known, and among them is a slot type shadow mask having a plurality of strips (long narrow pieces) extending in a direction perpendicular to a horizontal scanning direction of the electron beams emitted from the electron gun and a plurality of bridge portions for connecting two adjacent strips such that each of rectangular electron beam apertures (which are called "slots") is defined by two adjacent strips and two adjacent bridge portions. This slot type shadow mask is tensed along the direction perpendicular to the horizontal scanning direction of the electron beams, for example, and it is known that it vibrates when an external shock is applied to it. If the shadow mask vibrates, the position of the electron beams passing through a slot is deviated, and thereby landing positions of the electron beams are deviated from their intended phosphor elements and the reproduced image also vibrates resulting in deterioration of image quality. Further, there is a case in which this vibration damages the shadow mask itself and therefore it is impossible to reproduce a normal image.

To prevent such vibration of the shadow mask, there is a technique to superpose a vibration-preventing wire on a slit extending in the direction perpendicular to the horizontal scanning direction of the electron beams (the vertical direction) and thereby to absorb the vibration, as disclosed in Japanese Patent Application Laid-open No. Hei 8-227,667.

FIG. 14 is a schematic perspective view of a prior art slot type shadow mask provided with a vibration-preventing structure. A shadow mask 8 is depicted as a constituent component of a shadow mask structure 7 stretched over mask frames 9*a*, 9*b*.

The pair of mask frames 9*a*, 9*b* are fixed to support frames 10*a*, 10*b* to form a peripheral frame, and the shadow mask 8 is stretched over the mask frames 9*a*, 9*b*. In the shadow mask 8, a large number of slot type electron beam apertures 20 are defined by a plurality of strips 21 extending in a direction (the Y-axis direction) perpendicular to a horizontal scanning direction (the X-axis direction) of the electron beams emitted from the electron gun and a plurality of bridge portions 22 for connecting two adjacent strips 21 to form an apertured area.

Vibration-preventing wires 12 are superposed on the respective strips 21 in a direction in which the strips 21 extend, and are fixed to the wire supports 11*a* attached to the mask frames 9*a*, 9*b*. The wire supports 11*a* are made of resilient material and apply a desired tension to the vibration-preventing wires 12.

On the other hand, Japanese Patent Application Laid-open No. Hei 5-198,271 discloses a color cathode ray tube in which a shadow mask comprised of strips only without no bridges (i.e., a shadow mask formed of a parallel array of narrow strips held together only at the ends) and a vibration-preventing wire is stretched over a surface of the shadow mask in the horizontal scanning direction and is pressed against the surface of the shadow mask to attenuate the vibration as much as possible. Incidentally, a plurality of vibration-preventing wires of this type are usually disposed in the horizontal scanning direction of the electron beams.

SUMMARY OF THE INVENTION

In the prior art shadow mask, it is difficult to make the vibration-preventing wire contact the surface of the shadow mask securely, and it is also inevitable for the vibration-preventing wire to be disposed to traverse the electron beam apertures.

Therefore, there have been pointed out problems that vibration of the shadow mask caused by external shock do not attenuate in a short period of time, or a horizontal black line appears in a reproduced image due to shadow in a phosphor screen caused by collision with the vibration-preventing wire, of the electron beams which are intended to pass through the electron beam apertures, resulting in deterioration of image quality.

It is an object of the invention to provide a color cathode ray tube having vibration of the shadow mask prevented without incurring deterioration in the image quality by eliminating the above problems with the prior art.

To achieve the above objects, in a shadow mask of the present invention, holes for positioning a vibration-preventing wire are opened at positions corresponding to ends of the strips, outside an apertured area of the shadow mask, and the vibration-preventing wire is passed through the holes and stretched.

The representative configurations of the present invention are as follows:

In accordance with the present invention, there is provided a color cathode ray tube comprising a vacuum envelope including a panel, a neck and a funnel for connecting the panel and the neck, an electron gun housed in the neck, a phosphor screen coated on an inner surface of the panel, and a shadow mask closely spaced from the phosphor screen and housed in the panel, the shadow mask having a plurality of strips extending in a direction perpendicular to a horizontal scanning direction of electron beams emitted from the electron gun and a plurality of bridge portions connecting adjacent ones among the plurality of strips, the shadow mask being formed with an apertured area having a plurality of slot-shaped electron beam apertures therein, each of the plurality of slot-shaped electron beam apertures being defined by two adjacent ones among the plurality of strips and two adjacent ones in the direction perpendicular to the horizontal scanning direction among the plurality of bridge portions, the shadow mask being provided with at least one wire held under tension in the extending direction of the plurality of strips so as to be superposed on a surface of one of the plurality of strips in the apertured area, and the surface of the one of the plurality of strips being a surface of the one of the plurality of strips facing the electron gun.

In accordance with the present invention, there is provided a color cathode ray tube comprising a vacuum envelope including a panel, a neck and a funnel for connecting the panel and the neck, an electron gun housed in the neck, a phosphor screen coating on an inner surface of the panel, and a shadow mask closely spaced from the phosphor screen and housed in the panel, the shadow mask having a plurality of strips extending in a direction perpendicular to a horizontal scanning direction of electron beams emitted from the electron gun and a plurality of bridge portions connecting adjacent ones among the plurality of strips, the shadow mask being formed with an apertured area having a plurality of slot-shaped electron beam apertures therein, each of the plurality of slot-shaped electron beam apertures being defined by two adjacent ones among the plurality of strips and two adjacent ones in the direction perpendicular to the horizontal scanning direction among the plurality of bridge portions, the shadow mask being provided with at least one wire held under tension in the extending direction of the plurality of strips so as to be superposed on a surface of one of the plurality of strips in the apertured area, the surface of the one of the plurality of strips being a surface of the one of the plurality of strips facing the electron gun, and both ends made of the at least one wire being brought out through holes opened onto a surface of the shadow mask facing the phosphor screen.

The strips of the shadow mask extend in a direction perpendicular to the horizontal scanning direction of the electron beams emitted from the electron gun, and therefore the vibration-preventing wire do not traverse the electron beam apertures and is disposed to be superposed on the strip.

Consequently, the shadow of the vibration-preventing wire is not projected on the phorphor, and therefore a high-quality image is obtained.

Further, by superposing the vibration-preventing wire so as to extend in an extending direction of the strips on a surface of a side of a strip which is convex in the extending direction of the strips, the vibration-preventing wire is pressed against the strip with the vibration-preventing wire in solid contact with the strip and provides an extremely great vibration-preventing effect.

Further, a plurality of the vibration-preventing wires can be arranged in the horizontal scanning direction of the electron beams, but the strips are connected together and integrally with the bridge portions, and therefore even a single vibration-preventing wire provides a vibration-preventing effect to vibration of the surface of the shadow mask.

It is needless to say the present invention is not limited to the above configurations or embodiments to be described subsequently, but various changes can be made without departing from the spirit of the present invention.

BRIEF DESCRIPTION OF THE DRAWINGS

In the accompanying drawings, in which like reference numerals designate similar components throughout the figures, and in which:

FIG. 8A is a schematic plan view thereof, and FIG. 8B is a cross-sectional view thereof taken along line VIII B—VIII B of FIG. 8A;

DETAILED DESCRIPTION OF THE PREFERRED EMBODIMENTS

Figure 1:
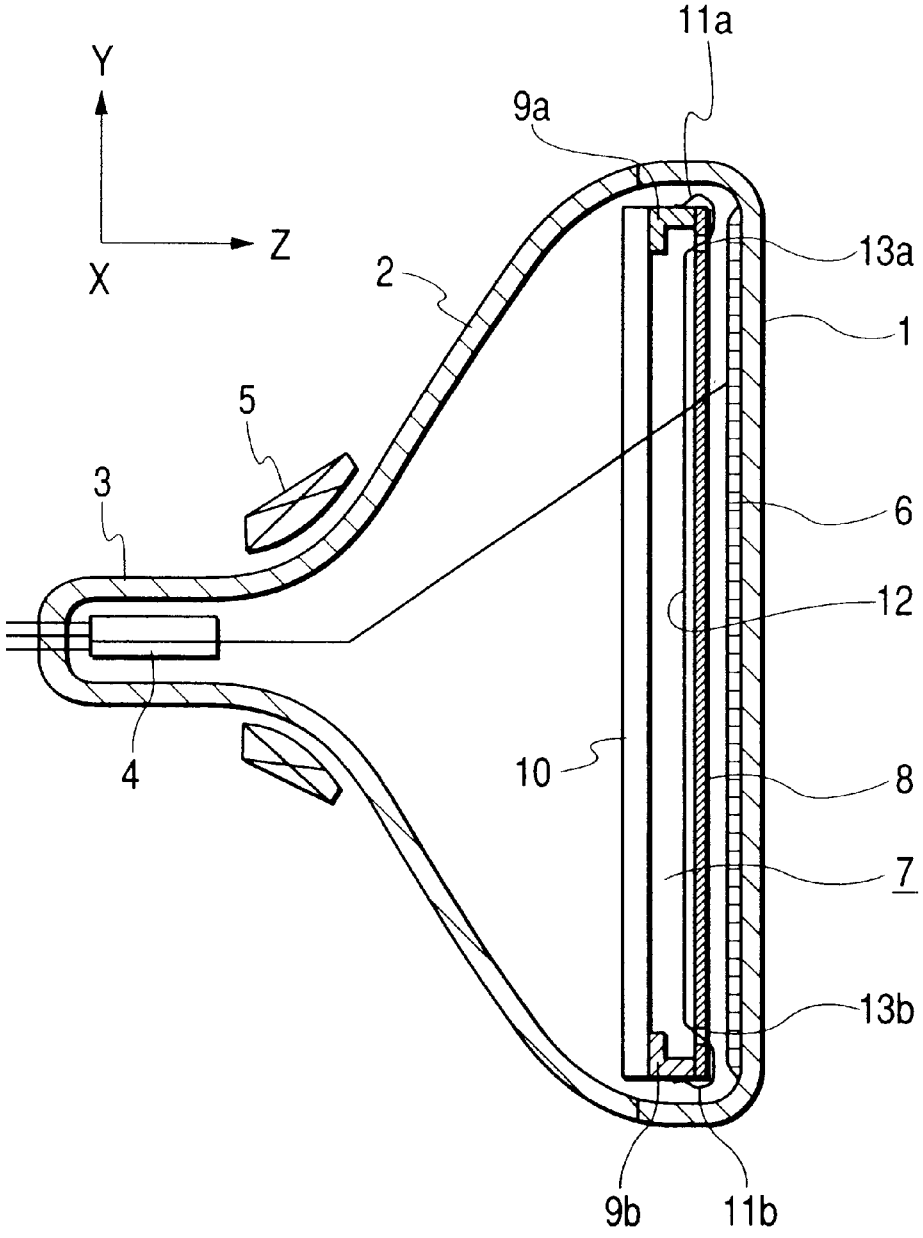
FIG. 1 is a schematic cross-sectional view for explaining a first embodiment of a color cathode ray tube in accordance with the present invention.

The embodiment of the present invention will be explained in detail by referring to the drawing of examples.

FIG. 1 is a schematic cross-sectional view for explaining a first embodiment of a color cathode ray tube in accordance with the present invention. In this color cathode ray tube, a vacuum envelope is comprised of a face panel 1 having a phosphor screen 6 formed by coating three color phosphors on an inner surface of the face panel 1, a neck 3 housing an electron gun 4 for emitting three in-line electron beams and a funnel 2 for connecting the face panel 1 and the neck 3.

The phosphor screen 6 has an arrangement in a matrix fashion of red-emitting, green-emitting and blue emitting phosphors which emit light of the respective colors when struck by red-associated, green-associated and blue-associated electron beams, respectively. One picture element for forming an image is formed by three phosphors including red-emitting, green-emitting and blue emitting phosphors which emit light of the respective colors when struck by three electron beams (a beam trio), respectively, passing through one of the electron beam apertures in the shadow mask 8 of the shadow mask structure 7.

A deflection yoke 5 mounted around the outside of a transition region between the funnel 2 and the neck 3 of the vacuum envelope deflects the three electron beams emitted from the electron gun 4 horizontally (in the X-axis direction) and vertically (in the Y-axis direction) to form a two-dimensional image on the phosphor screen 6. In FIG. 1, the Z axis corresponds to a tube axis.

A shadow mask structure 7 comprises a pair of approximately parallel mask frames 9*a*, 9*b*, a pair of support frames 10 for forming a peripheral frame together with the mask frames 9*a*, 9*b*, and a shadow mask 8 welded to the pair of approximately parallel mask frames 9*a*, 9*b*. The shadow mask structure 7 is suspended at the inner wall of a skirt portion of the face panel 1 by a suspension mechanism (not shown).

The support frames 10 for holding the mask frames 9*a*, 9*b* approximately in parallel with each other are two in number (a pair), are each attached to the respective ends of the mask frames and are made of resilient material such that a force is applied to pull the pair of the mask frames 9*a*, 9*b* apart. That is to say, in fixing the shadow mask to the mask frames 9*a*, 9*b*, initially a compressive force is applied to bend the mask frames 9*a*, 9*b* in such a direction as to push them toward each other, and then in this state the shadow mask 8 is welded to the mask frames 9*a*, 9*b*. Next, by releasing the compressive force, a tension in the vertical direction (the Y-axis direction) is applied to the shadow mask 8. The mask frames 9*a*, 9*b* are convex toward the panel 1 with a radius of curvature of 4300 mm for example.

With this structure, the slot type shadow mask 8 is put under uniform tension in the vertical direction (the Y-axis direction) perpendicular to the horizontal direction (the X-axis direction).

The shadow mask structure 7 is provided with a vibration-preventing wire 12 stretched to contact a surface of an apertured area of the shadow mask 8 on the side of the shadow mask that faces the electron gun 4 in parallel with a vertical scanning direction. The vibration-preventing wire 12 is brought out to the panel 1 side of the shadow mask 8 through holes 13*a*, 13*b* for positioning the wire opened outside of the apertured area of the shadow mask 8, and both ends of the vibration-preventing wire 12 are fixed to wire supports 11*a*, 11*b* as by welding.

The wire supports 11*a*, 11*b* are welded at one end thereof to the mask frames 9*a*, 9*b*, respectively, and the other ends of the wire supports 11*a*, 11*b* are free ends. The vibration-preventing wire 12 is welded to the free ends of the wire supports 11*a*, 11*b* in a state in which a compressive force is applied to bend the free ends in such a direction as to push them toward each other, and then by releasing the compressive force, the vibration-preventing wire 12 is put under tension.

Figure 2:
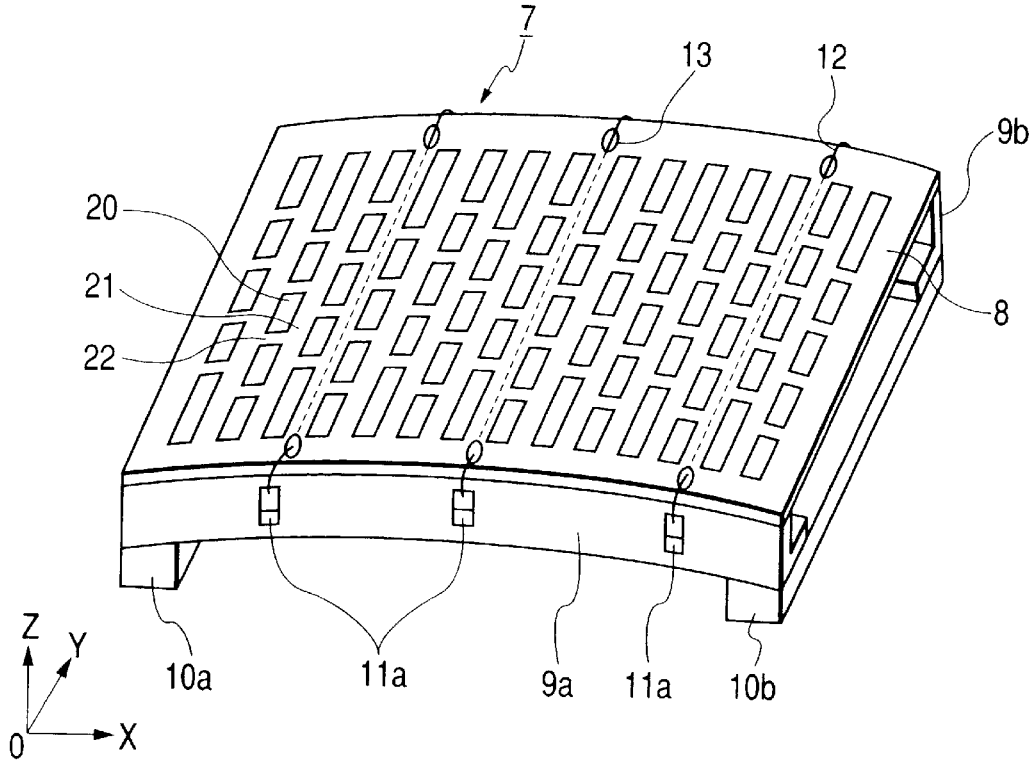
FIG. 2 is a perspective view for explaining schematically a configuration of a shadow mask structure in FIG. 1.
Figure 14:
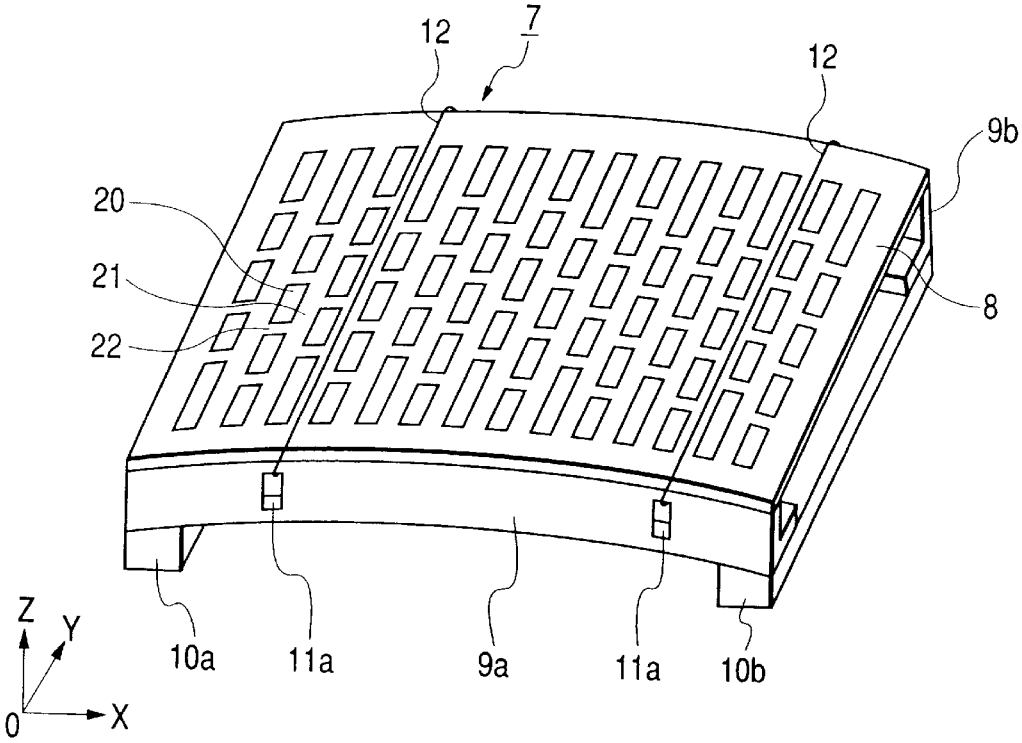
FIG. 14 PRIOR ART
FIG. 14 is a schematic perspective view of a slot type shadow mask provided with a prior art vibration-preventing structure.

FIG. 2 is a perspective view for explaining schematically a configuration of the shadow mask structure 7 in FIG. 1. The shadow mask 8 is depicted as a constituent component of the shadow mask structure 7 stretched over the mask frames 9*a*, 9*b* like the shadow mask 8 explained in FIG. 14.

The slot type shadow mask 8 is made of an iron-nickel alloy sheet of 0.06 mm in thickness, and is held under tension between the pair of mask frames 9*a*, 9*b* arranged in parallel with each other.

A major portion of the shadow mask 8 is formed with electron beam apertures 20. The electron beam apertures 20 are in the form of so-called slots and are defined by two adjacent strips 21 and two adjacent bridge portions 22 connecting the two adjacent strips 21 together in the horizontal direction (the X-axis direction) with the major axes of the electron beam apertures in the vertical direction (the Y-axis direction). The area of the shadow mask 8 formed with the electron beam pertures 20 is called the apertured area.

Figure 3:
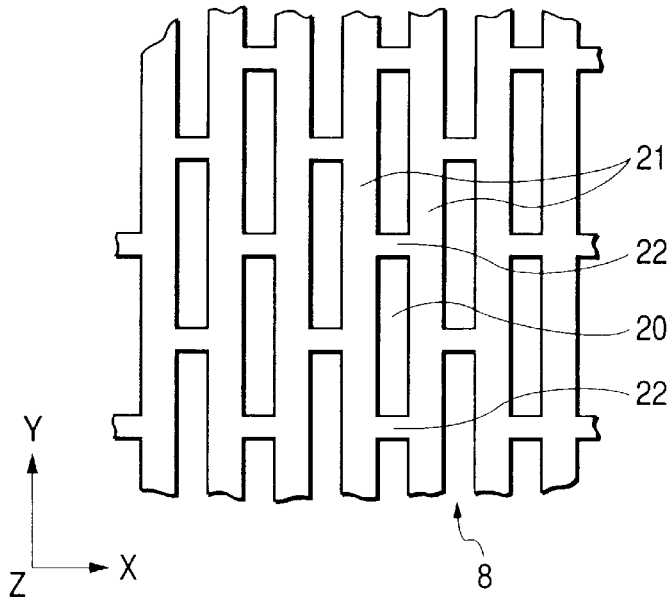
FIG. 3 is an enlarged detailed view of electron beam apertures in an essential part of an apertured area of FIG. 2.

FIG. 3 is a detailed view of an essential part of the apertured area for illustrating an enlarged view of the electron beam apertures in FIG. 2. The strips 21 extend linearly in the Y-axis direction, and are arranged in the X-axis direction at an equal interval, for example. The bridge portions 22 extending in the X-axis direction in FIG. 3 connect the two adjacent strips 21 together because it is difficult to handle the shadow mask comprised of the strips 21 only.

The bridge portions 22 are disposed at an approximately equal interval in the Y-axis direction, and the bridge portions 22 in one column are offset by half the equal interval in the Y-axis direction from the bridge portions 22 in the columns immediately adjacent in the X-axis direction. Incidentally, this slot type shadow mask 8 has a size of 300 mm in the Y-axis direction and 400 mm in the X-axis direction, a thickness of 0.06 mm, and is formed with electron beam apertures (slots) of 0.052 mm×0.21 mm arranged with a pitch in the X-axis direction of 0.25 mm and a pitch in the Y-axis direction of 0.26 mm.

As shown in FIG. 2, the vibration-preventing wire 12 is attached to the shadow mask structure 7 so as to prevent vibration of the shadow mask 8. The vibration-preventing wire 12 is made of alloy of tungsten and rhenium, for example, and is stretched to be superposed on a strip 21 lying between the electron beam apertures 20 adjacent in the X-axis direction, and between the mask frames 9*a*, 9*b*. In FIG. 2, three vibration-preventing wires 12 are employed.

To make the vibration-preventing wires 12 contact the strips 21 securely, each of the vibration-preventing wires 12 is superposed on a surface of the strip 21 of the shadow mask 8 on the electron gun side in the apertured area of the shadow mask 8, and is brought out on a surface of the shadow mask 8 on the panel side through the holes 13 opened outside of the apertured area.

Both ends of the vibration-preventing wires 12 brought out on the surface of the shadow mask 8 on the panel side are attached under tension to the wire supports 11*a*, 11*b* attached to the mask frames 9*a*, 9*b*. With this structure, the vibration-preventing wires 12 are disposed without traversing the electron beam apertures 20 at all.

In fixing the vibration-preventing wires 12 to the wire supports 11*a*, 11*b*, the wire supports 11*a*, 11*b* attached to the mask frames 9*a*, 9*b* are pushed toward each other, and then in this state the vibration-preventing wires are welded to the wire supports and then the compressive force applied to the wire supports is released. With this configuration, the vibration-preventing wire 12 is held under tension, is pressed against the surface of the shadow mask 8 and consequently, prevents the vibration of the shadow mask 8.

Figure 4:
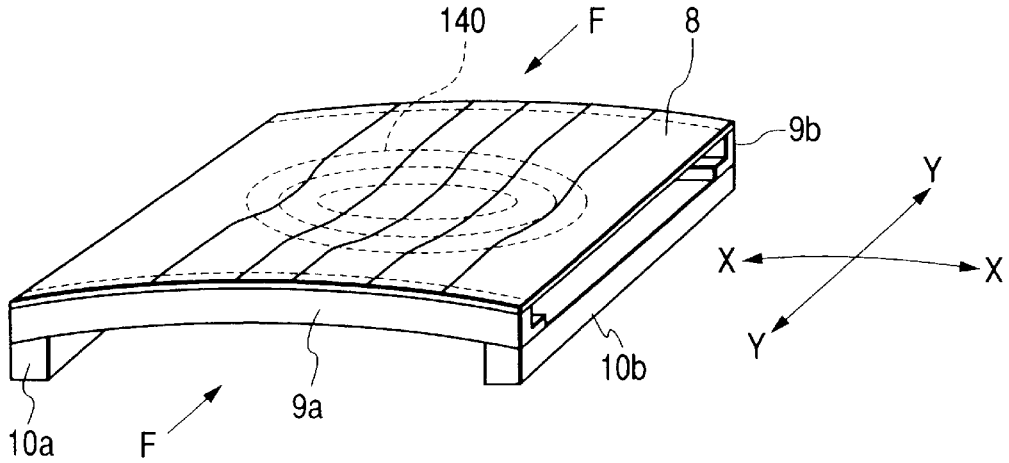
FIG. 4 is a schematic for explaining a condition of a surface of a shadow mask stretched over a mask frame.

The following explains by reference to FIG. 4 the reason why the vibration-preventing wire 12 is superposed on the surface of the strip 21 of shadow mask 8 on the electron gun side in the apertured area of the shadow mask 8.

FIG. 4 is a schematic for explaining a condition of the surface of the shadow mask stretched over the mask frame. The shadow mask 8 is stretched between a pair of mask frames 9*a*, 9*b*. The stretching operation is performed as follows. A compressive force F is applied to the pair of the mask frames 9*a*, 9*b* in such a direction as to push them toward each other, and then in this state, edges of the shadow mask 8 are welded to the mask frames 9*a*, 9*b*. After welding, by releasing the compressive force F, the shadow mask 8 is held under tension between the mask frames 9*a*, 9*b*. The pair of mask frames 9*a*, 9*b* are convex toward the panel. In the shadow mask 8 formed with the slots 20, the strips 21 of the shadow mask 8 are connected together with the bridge portions 22 in the X-axis direction, therefore a tension in the Y-axis direction produces a component which pull adjacent strips 21 in the X-axis direction, and therefore the strips 21 are deformed to be convex toward the electron gun in the extending direction of the strips (the Y-axis direction) as indicated by ellipses 140 depicted by broken lines in FIG. 4.

The vibration-preventing wires 12 contacts the strips 21 of the shadow mask 8 securely because the surface of the shadow mask 8 is convex toward the electron gun. The vibration-preventing wires push the surface of the shadow mask 8 on the electron gun side because they are held under tension.

The holes 13 opened outside of the apertured area of the shadow mask 8 for passing the vibration-preventing wire 12 therethrough are made by etching simultaneously with making of the slot pattern of the shadow mask 8, and therefore the precision of the positions of the holes 13 is easily obtained.

The holes 13 may be opened perpendicularly to the surface of the shadow mask 8, but if the holes 13 are inclined with respect to the normal to the surface of the shadow mask 8 in a cross section containing the extending direction of the vibration-preventing wires, the vibration-preventing wires can be passed smoothly through the holes 13, and contact the surface of the shadow mask 8 securely, and consequently, more effective vibration prevention is obtained.

Figure 5A:
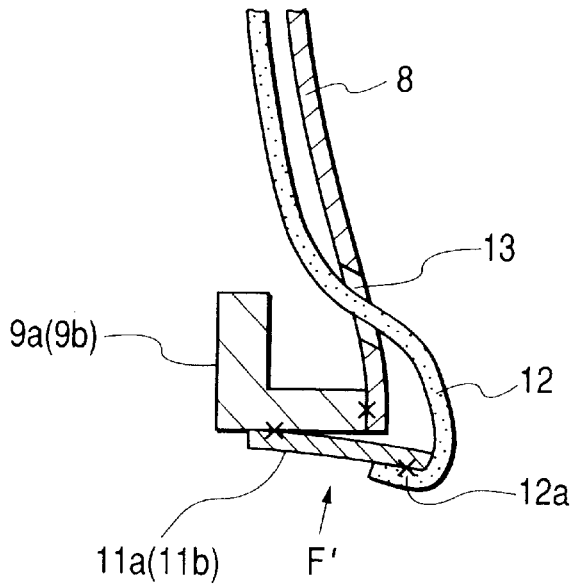
FIGS. 5A and 5B are cross-sectional views of an essential part for explaining a structure for stretching a vibration-preventing wire in the present embodiment.
Figure 5B:
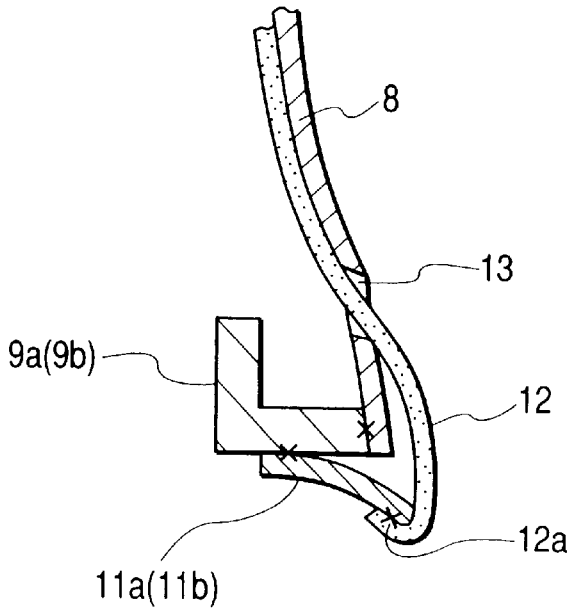

FIGS. 5A and 5B are cross-sectional views of an essential part for explaining a structure for stretching the vibration-preventing wire in the present embodiment. FIG. 5A illustrates a state in which the vibration-preventing wire 12 is passed through the hole 13 opened outside the apertured area of the shadow mask 8, then the wire supports 11*a* (11*b*) welded to the mask frames 9*a* (9*b*) are compressed in a direction denoted by an arrow F', and then ends of the vibration-preventing wire 12 are welded and fixed to the wire supports 11*a* (11*b*). Reference numeral 12*a* denotes a weld point.

In this embodiment, the holes 13 opened in the shadow mask 8 are inclined with respect to the normal to the surface of the shadow mask 8 in a cross section containing the extending direction of the vibration-preventing wire 12. That is to say, the holes 13 are opened outside the apertured area of the shadow mask 8, centers of the holes 13 on the side opposite from the convex-surface side (the electron gun side) of the shadow mask 8 are displaced outwardly from centers of the corresponding holes 13 on the convex-surface side of the shadow mask 8 in a direction perpendicular to the horizontal scanning direction of the electron beams.

In the above-mentioned state, by releasing the compressive force applied to the wire supports 11*a* (11*b*), the vibration-preventing wire 12 are pulled outwardly toward the sides of the shadow mask by resiliency of the wire supports 11*a* (11*b*) as shown in FIG. 5B, and consequently, the vibration-preventing wire 12 is brought into solid contact with the surface of the shadow mask 8 on the convex-surface side and presses the shadow mask 8.

With this configuration, the vibration-preventing wires can be passed smoothly along the inner walls of the holes, local contact resistance between the vibration-preventing wires and the holes in the relative motion of the wires over the shadow mask caused by changes in temperature or the like is reduced, and therefore dust or broken lines are prevented from being produced by friction, vibration is prevented and high-quality images can be reproduced.

In this embodiment, the vibration-preventing wires 12 are made of a wire of 0.09 mm in diameter, but it is confirmed by experiments of the present inventors that wires having a diameter of 0.06 to 0.6 times a pitch of slots (electron beam apertures) in the X-axis direction on the X axis, of the shadow mask 8 are suitable for the vibration-preventing wires. That is to say, the vibration-preventing wire having a diameter smaller than values in the above range of the diameters reduces the vibration-preventing effect, and if the vibration-preventing wire has a diameter larger than values in the above range of the diameters, there is a possibility that the vibration-preventing wire extends beyond the slots and casts a shadow on the phosphor screen.

As explained in the first embodiment of the present invention, when the mask frames 9*a*, 9*b* are formed to be convex toward the panel (the phosphor screen) on the panel side (the phosphor screen side), the slot type shadow mask 8 is deformed to be convex toward the electron gun (the neck) in the extending direction of the strips 21 with the maximum curvature on the Y axis. That is to say, the slot type shadow mask 8 has a concave surface in the form of a saddle when it is viewed from the panel side.

When the phosphor screen is patterned by using such a shadow mask, it is natural that distortions occur in the arrangement of each of the phosphors. To correct the distortions in the arrangement of the phosphors, it is effective to decrease pitches of the electron beam apertures (the slots) in the X-axis direction (the horizontal direction) on the Y axis with increasing distance (upward and downward) along the Y axis from the origin (the center of the shadow mask 8) of the system of X-Y coordinates.

But it is preferable to superpose the vibration-preventing wire 12 on a straight strip in view of the vibration-preventing effect.

Figure 6:
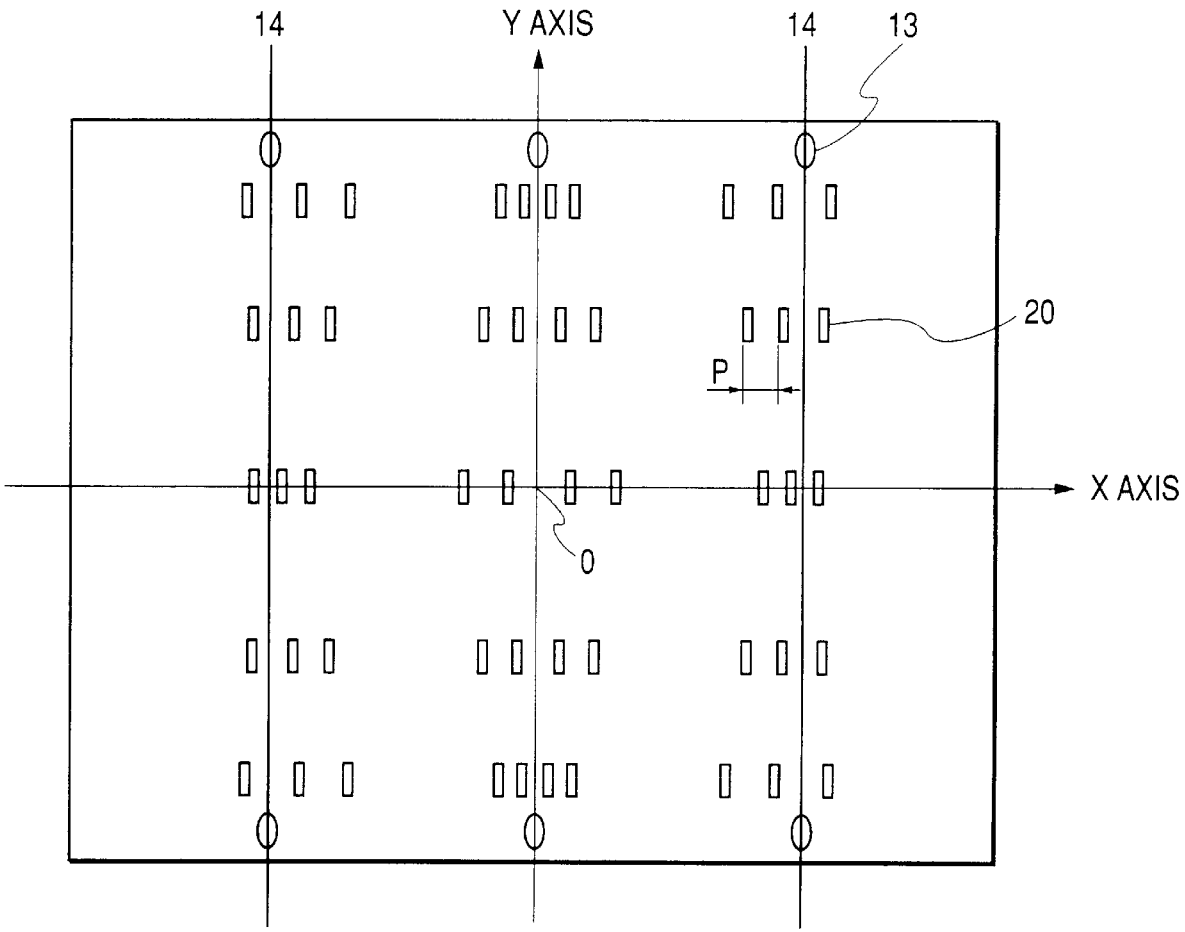
FIG. 6 is a schematic plan view of a shadow mask for explaining a second embodiment of a color cathode ray tube in accordance with the present invention.

FIG. 6 is a schematic plan view of a shadow mask for explaining a second embodiment of a color cathode ray tube in accordance with the present invention. As shown in FIG. 6, the pitches P of the slots 20 in the horizontal direction on the X axis are decreased with increasing distance (leftward and rightward) from the origin 0 on the X axis, and the pitches P of the slots 20 on the Y axis are decreased with increasing distance (upward and downward) from the origin 0 on the Y axis.

On the other hand, in the vicinities of the top and bottom sides of the apertured area of the shadow mask 8, the pitches P are increased with increasing distance from the Y axis, and in the vicinities of the left and right sides of the apertured area of the shadow mask 8, the pitches P are increased with increasing distance from the X axis.

In this arrangement of the slots, strips are disposed to be present at positions of the vibration-preventing wires indicated by straight lines 14.

With this configuration, the correction of the arrangement of phosphors and the prevention of vibration consist together and high-quality images are obtained.

Figure 7A:
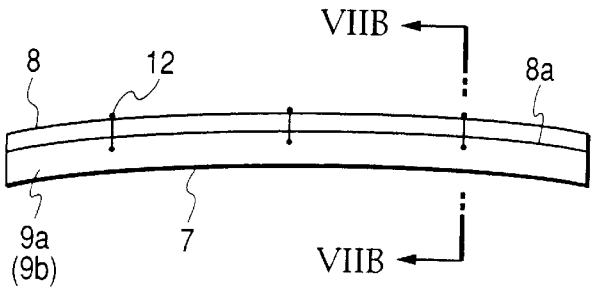
FIG. 7A is a schematic side view of a shadow mask for explaining other embodiments of a color cathode ray tube in accordance with the present invention.

FIGS. 7A to 7D is a schematic side view of a shadow mask for explaining other embodiments of a color cathode ray tube in accordance with the present invention, and are cross-sectional views of essential parts of the other embodiments, respectively. In these embodiments, as shown in FIG. 7A, outer edges of portions of the shadow mask 8 welded to the mask frames 9*a* (9*b*) are extended to provide stretching means 8*a* for applying tension to the vibration-preventing wire 12.

Figure 7B:
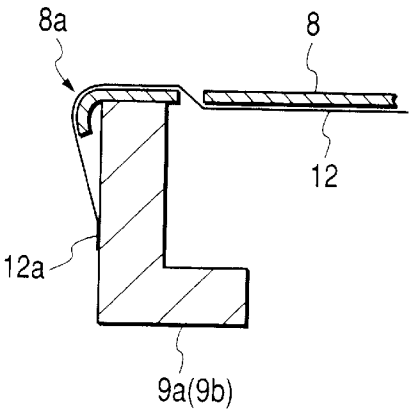
FIGS. 7B to 7D are cross-sectional views of essential parts of the other embodiments, respectively.

In an example of the stretching means 8*a* shown in FIG. 7B, the extended outer edges of welded portions of the shadow mask 8 are slightly curved, and the vibration-preventing wire 12 is welded and fixed to the mask frames 9*a* (9*b*) at weld points 12*a* such that the vibration-preventing wire 12 compresses and bends the upper portions of the curved edges to impart resiliency thereto.

Figure 7C:
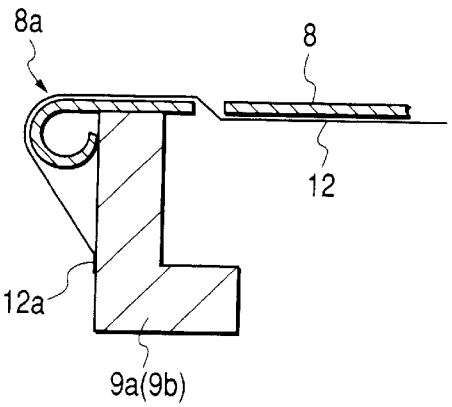

In another example of the stretching means 8*a* shown in FIG. 7C, the extended outer edges of welded portions of the shadow mask 8 are curled to contact the mask frames 9*a* (9*b*), and the vibration-preventing wire 12 is fixed in a state in which the curled portions are compressed to be collapsed.

Figure 7D:
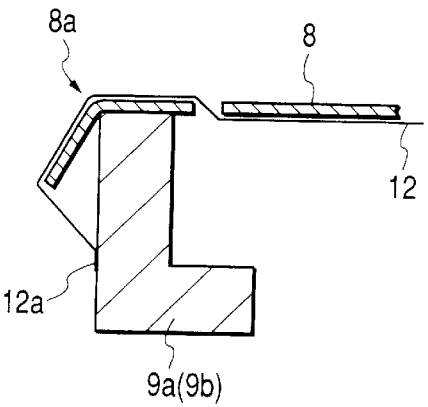

In still another example of the stretching means 8*a* shown in FIG. 7D, the extended outer edges of welded portions of the shadow mask 8 are bent to provide comparatively long, flat bent portions, then the bent portions are compressed, and then ends of the vibration-preventing wire 12 are welded and fixed to the mask frames 9*a* (9*b*) with the vibration-preventing wire 12 superposed on the compressed bent portions.

The above configurations eliminates the need for wire supports separate from the mask frames for stretching the vibration-preventing wires 12, and consequently, the assembling operation is simplified.

Figure 8B:
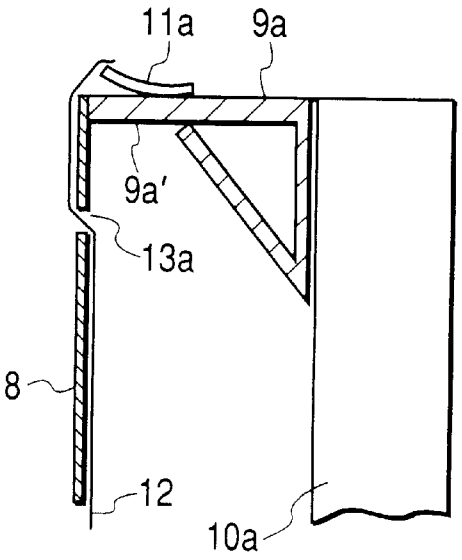
FIGS. 8A and 8B are illustrations for explaining an example of a configuration of a mask frame constituting a mask structure used for an embodiment of a color cathode ray tube in accordance with the present invention.
Figure 8A:
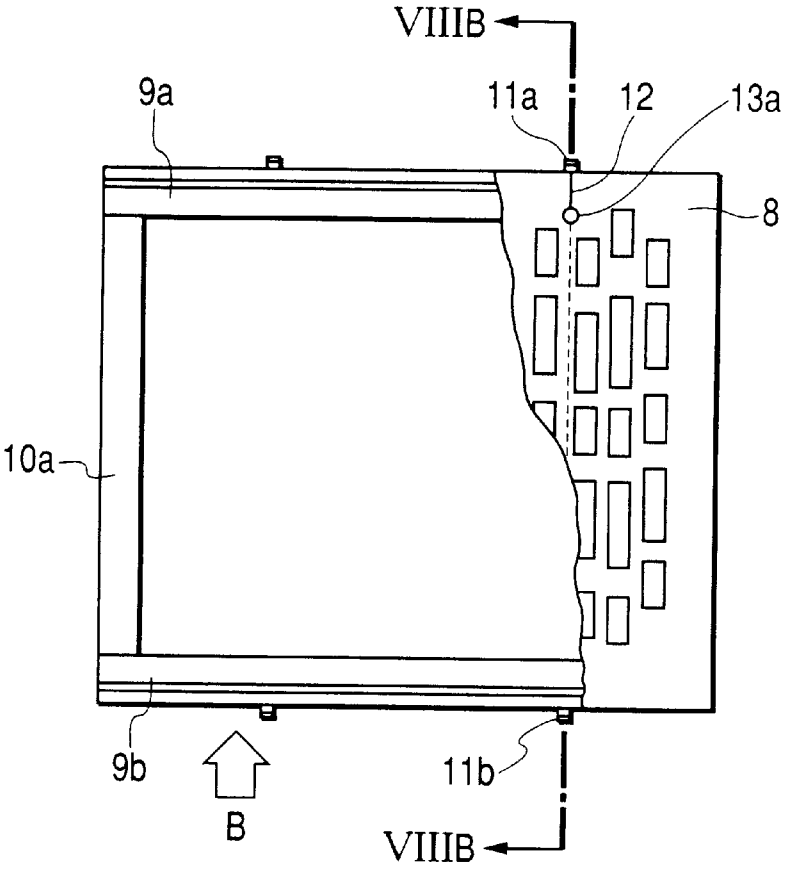

FIGS. 8A and 8B are illustrations for explaining an example of a configuration of a mask frame constituting a mask structure used for an embodiment of a color cathode ray tube in accordance with the present invention, and FIG. 8B is a cross-sectional view thereof taken along line VIII B—VIII B of FIG. 8A. In this example, the mask frames 9*a* (9*b*) are made of plates bent to have an approximately triangular cross section. With this configuration of the mask frames 9*a* (9*b*), in welding the shadow mask 8 to the mask frames 9*a* (9*b*), sufficient resiliency is imparted to the mask frames by bending the portions 9*a*′ to be welded to the shadow mask 8 by an external force, and also the weight and cost of the mask frames are reduced.

Figure 9A:
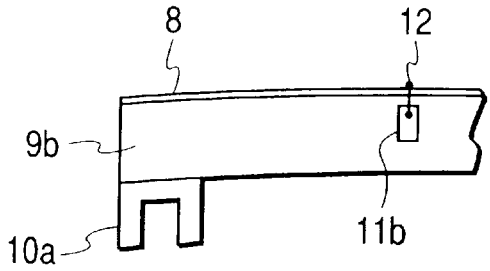
FIGS. 9A to 9C are illustrations for explaining examples of configurations of support frames constituting a shadow mask structure used for embodiments of a color cathode ray tube in accordance with the present invention, respectively.
Figure 9B:
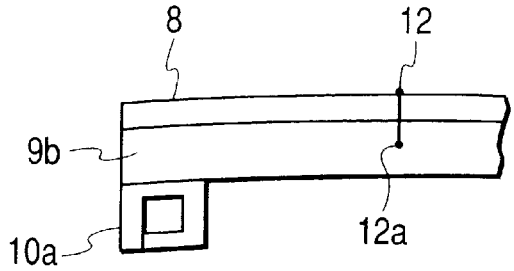
Figure 9C:
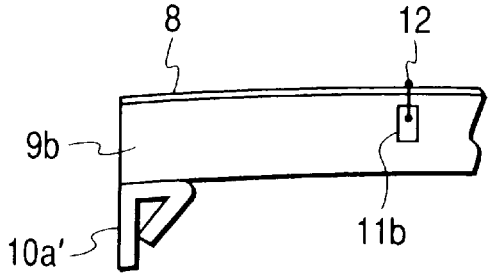

FIGS. 9A to 9C are illustrations for explaining examples of configurations of support frames constituting a shadow mask structure used for embodiments of a color cathode ray tube in accordance with the present invention, respectively. In these examples of the configurations, the support frames 10*a*, 10*b* for holding the mask frames 9*a*, 9*b* in parallel with each other to form a rectangular peripheral frame are formed by bending plates as in the case of the mask frames explained in connection with FIGS. 8A and 8B.

An example of the support frame shown in FIG. 9A is fabricated by bending a plate to form a generally U-shaped cross section, and the support frames are welded to the mask frame. Another example of the support frame shown in FIG. 9B is fabricated by bending a plate to form a rectangular cross section, and still another example of the support frame shown in FIG. 9C is fabricated by bending a plate to form a triangular cross section.

All of the support frames shown in FIGS. 9A to 9C can reduce weight and cost, and they can reduce weight and cost of the shadow mask in combination with the mask frames shown in FIGS. 8A and 8B.

The structure for fixing the vibration-preventing wires 12 can adopt one of those shown in FIGS. 9A to 9C, or one of those explained in connection with FIGS. 7A to 7D, but it might be thought that, without opening the holes 13 outside of the apertured area of the shadow mask 8, grooves extending in the Y-axis direction are cut in surfaces of the mask frames to be welded to the shadow mask and the vibration-preventing wires 12 are held in the grooves and fixed. But it is preferable to use the holes 13 in view of positioning accuracy required of the strips of the shadow mask 8 and the vibration-preventing wires 12.

Figure 10:
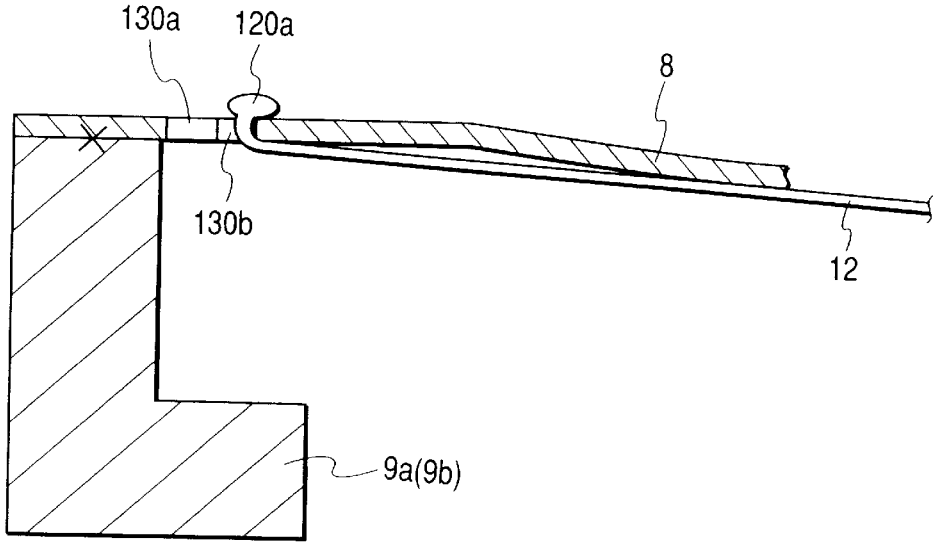
FIG. 10 is an illustration for explaining a structure for fixing a vibration-preventing wire constituting a shadow mask structure in an embodiment of a color cathode ray tube in accordance with the present invention.
Figure 11A:
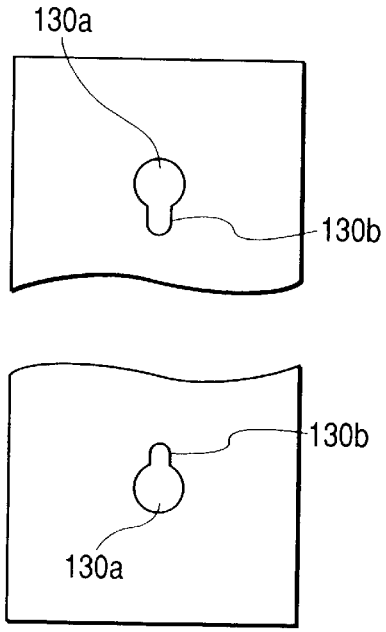
FIGS. 11A and 11B are plan views of an essential part for explaining the configuration of FIG. 10.
Figure 11B:
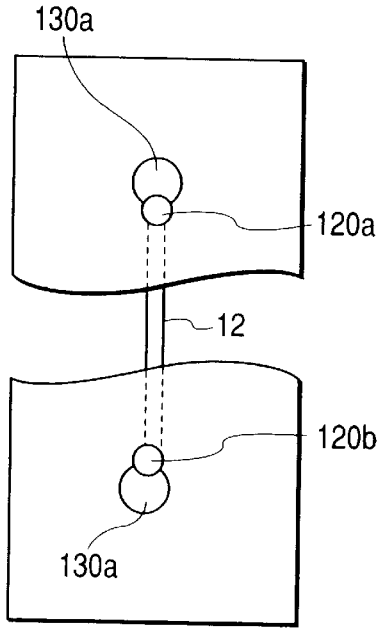

FIG. 10 is an illustration for explaining another example of a structure for fixing vibration-preventing wires constituting a shadow mask structure in an embodiment of a color cathode ray tube in accordance with the present invention, and FIGS. 11A and 11B are plan views of an essential part for explaining the configuration of FIG. 10. In this example of the configuration, the holes opened outside of the apertured area of the shadow mask 8 are in the form of a keyhole.

Each end of the vibration-preventing wire 12 is provided with a head 120*a* larger than a diameter of the vibration-preventing wire 12, and the holes opened outside of the aperture area of the shadow mask have a large-diameter portion 130*a* for passing the head 120*a* of the vibration-preventing wire 12 and a small-diameter engaging groove 130*b* smaller in diameter than the head 120*a* and communicating with the large-diameter portion 130*a*.

In fitting the vibration-preventing wire 12 into the holes, first the heads 120*a* of the vibration-preventing wire 12 are passed through the large-diameter portion 130*a* and then are engaged with the engaging groove 130*b* while the mask frames 9*a* (9*b*) are bent by pushing them inwardly, and then by releasing the pushing force applied to the mask frames, tension is imparted to the vibration-preventing wire 12.

With this configuration, the required vibration-preventing effect and structure are obtained without the need for components for fixing the vibration-preventing wire 12.

Figure 12:
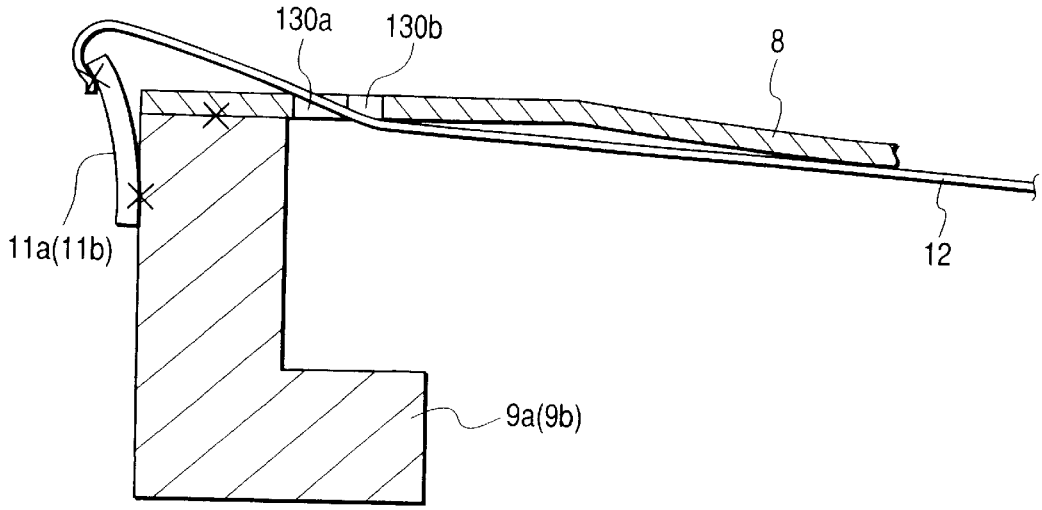
FIG. 12 is an illustration for explaining a structure for fixing a vibration-preventing wire constituting a shadow mask structure in still another embodiment of a color cathode ray tube in accordance with the present invention.
Figure 13A:
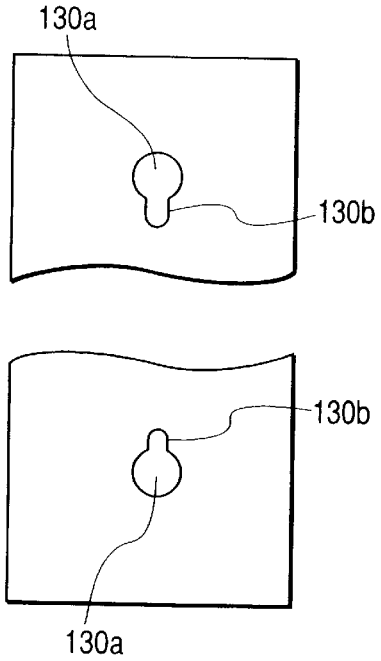
FIGS. 13A and 13B are plan views of an essential part for explaining the configuration of FIG. 12.
Figure 13B:
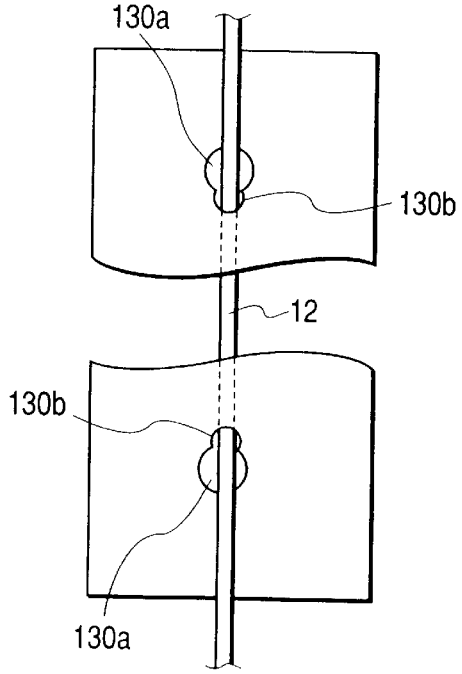

FIG. 12 is an illustration for explaining a structure for fixing a vibration-preventing wire constituting a shadow mask structure in still another embodiment of a color cathode ray tube in accordance with the present invention, and FIGS. 13A and 13B are plan views of an essential part for explaining the configuration of FIG. 12. In this embodiment also, the holes opened outside of the apertured area of the shadow mask 8 are the same as those shown in FIGS. 11A and 11B.

In this embodiment, as shown in FIGS. 13A and 13B, the holes opened outside of the apertured area are in the form of a combination of a large-diameter hole 130*a* and a small-diameter hole 130*b* communicating with the large-diameter hole 130*a*, and the vibration-preventing wire 12 is passed through the large-diameter hole 130*a* having a larger diameter than the diameter of the vibration-preventing wire 12 and is welded and fixed to the wire supports 11*a* (11*b*) welded to the mask frames 9*a* (9*b*).

In this embodiment, the small-diameter holes 130*b* communicate with the large-diameter holes 130*a*, both the small-diameter holes 130*b* are disposed to be approximately opposed to each other as shown in FIG. 13B. By pulling the vibration-preventing wire 12 passed through the large-diameter hole 130*a*, the vibration-preventing wire 12 is fitted into the small-diameter hole 130*b*, and consequently, positioning of the wire is carried out with accuracy and ease.

Each of the above embodiments in accordance with the present invention provides a color cathode ray tube capable of preventing vibration of the shadow mask without deteriorating image quality.

In the above explanation, it was assumed that the strips are deformed to be convex toward the electron gun in the extending direction of the strips, but it is needless to say that the present invention is applicable to a case in which the strips are deformed to be convex toward the phosphor screen in the extending direction of the strips.

As explained above, in the present invention, the vibration-preventing wires are capable of pressing the surface of the shadow mask and thereby preventing the vibration of the shadow mask without the wires extending into the electron beam apertures, and reproducing high-quality images.

What is claimed is:

1. A color cathode ray tube comprising a vacuum envelope including a panel, a neck and a funnel for connecting said panel and said neck, an electron gun housed in said neck, a phosphor screen coated on an inner surface of said panel, and a shadow mask closely spaced from said phosphor screen and housed in said panel, wherein said shadow mask has a plurality of strips extending in a direction perpendicular to a horizontal scanning direction of electron beams emitted from said electron gun and a plurality of bridge portions connecting adjacent ones among said plurality of strips, said shadow mask is formed with a plurality of slot-shaped electron beam apertures therein, each of said plurality of slot-shaped electron beam apertures is defined by two adjacent ones among said plurality of strips and two adjacent ones in the direction perpendicular to the horizontal scanning direction among said plurality of bridge portions, and said shadow mask is provided with at least one wire held under tension in the extending direction of said plurality of strips so as to be superposed on a surface of one of said plurality of strips which faces said electron gun.

2. A color cathode ray tube according to claim 1, wherein a following inequality is satisfied, $$0.06\times Ph \leqq \Phi \leqq 0.6\times Ph$$

where Φ(mm) is a diameter of said at least one wire, and

Ph (mm) is a pitch of said electron beam apertures in the horizontal scanning direction on a horizontal center line of said phosphor screen.

3. A color cathode ray tube comprising a vacuum envelope including a panel, a neck and a funnel for connecting said panel and said neck, an electron gun housed in said neck, a phosphor screen coated on an inner surface of said panel, and a shadow mask closely spaced from said phosphor screen and housed in said panel, wherein said shadow mask has a plurality of strips extending in a direction perpendicular to a horizontal scanning direction of electron beams emitted from said electron gun and a plurality of bridge portions connecting adjacent ones among said plurality of strips, said shadow mask is formed with a plurality of slot-shaped electron beam apertures therein, each of said plurality of slot-shaped electron beams apertures is defined by two adjacent ones among said plurality of strips and two adjacent ones in the direction perpendicular to the horizontal scanning direction among said plurality of bridge portions, said shadow mask is provided with at least one wire held under tension in the extending direction of said plurality of strips so as to be superposed on a surface of one of said plurality of strips which faces said electron gun, and both ends of said at least one wire are brought out through holes opened onto said shadow mask towards said phosphor screen, respectively.

4. A color cathode ray tube according to claim 3, wherein said shadow mask is stretched over a peripheral frame member and said ends of said at least one wire are fixed to said peripheral frame member via resilient members.

5. A color cathode ray tube according to claim 4, wherein one opening of each of said holes facing said phosphor screen is placed farther from a center of the shadow mask than another opening of each of said each of said holes facing said electron gun.

6. A color cathode ray tube according to claim 5, wherein a following inequality is satisfied, $$0.06\times Ph \leqq \Phi \leqq 0.6\times Ph$$

where

Φ(mm) is a diameter of said at least one wire, and

Ph (mm) is a pitch of said electron beam apertures in the horizontal scanning direction on a horizontal center line of said phosphor screen.

7. A color cathode ray tube according to claim 4, wherein a following inequality is satisfied, $$0.06\times Ph \leqq \Phi \leqq 0.6\times Ph$$

where

Φ(mm) is a diameter of said at least one wire, and

Ph (mm) is a pitch of said electron beam apertures in the horizontal scanning direction on a horizontal center line of said phosphor screen.

8. A cathode ray tube according to claim 3, wherein one opening of each of said holes facing said phosphor screen is placed farther from a center of the shadow mask than another opening of said each of said holes facing said electron gun.

9. A color cathode ray tube according to claim 8, wherein a following inequality is satisfied, $$0.06\times Ph \leqq \Phi \leqq 0.6\times Ph$$

where

Φ(mm) is a diameter of said at least one wire, and

Ph (mm) is a pitch of said electron beam apertures in the horizontal scanning direction on a horizontal center line of said phosphor screen.

10. A color cathode ray tube according to claim 3, wherein each of said ends of said at least one wire has a cross-section larger than a cross-section of a body of said at least one wire, each of said holes of said shadow mask has an opening for passing said each of said ends therethrough and a groove having a cross-section smaller than said each of said ends and communicating with said opening thereby engaging and fixing said each of said ends therein, respectively.

11. A color cathode ray tube according to claim 10, wherein a following inequality is satisfied, $$0.06\times Ph \leqq \Phi \leqq 0.6\times Ph$$

where

Φ(mm) is a diameter of said at least one wire, and

Ph (mm) is a pitch of said electron beam apertures in the horizontal scanning direction on a horizontal center line of said phosphor screen.

12. A color cathode ray tube according to claim 3, wherein a following inequality is satisfied, $$0.06\times Ph \leqq \Phi \leqq 0.6\times Ph$$

where

Φ(mm) is a diameter of said at least one wire, and

Ph (mm) is a pitch of said electron beam apertures in the horizontal scanning direction on a horizontal center line of said phosphor screen.

* * * * *